US008714692B1

(12) United States Patent
Metcalfe et al.

(10) Patent No.: US 8,714,692 B1
(45) Date of Patent: May 6, 2014

(54) SYSTEM AND METHOD OF COMPENSATING FOR DEFECTIVE INKJETS WITH CONTEXT DEPENDENT IMAGE DATA

(71) Applicant: Xerox Corporation, Norwalk, CT (US)

(72) Inventors: David Jon Metcalfe, Marion, NY (US); Stephen Michael Kroon, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/693,922

(22) Filed: Dec. 4, 2012

(51) Int. Cl.
*B41J 29/393* (2006.01)
*B41J 29/38* (2006.01)
*B41J 19/14* (2006.01)

(52) U.S. Cl.
CPC ..... *B41J 29/393* (2013.01); *B41J 29/38* (2013.01); *B41J 19/145* (2013.01)
USPC ..... 347/19

(58) Field of Classification Search
CPC ..... B41J 29/393; B41J 29/38; B41J 19/145
USPC ..... 347/14, 15, 19
See application file for complete search history.

(56) References Cited

U.S. PATENT DOCUMENTS

| | | | | |
|---|---|---|---|---|
| 3,946,398 | A | 3/1976 | Kyser et al. | |
| 4,907,013 | A | 3/1990 | Hubbard et al. | |
| 4,963,882 | A | 10/1990 | Hickman | |
| 5,581,284 | A | 12/1996 | Hermanson | |
| 5,635,967 | A | 6/1997 | Klassen | |
| 5,640,183 | A | 6/1997 | Hackleman | |
| 6,161,919 | A | 12/2000 | Klassen | |
| 6,215,557 | B1 | 4/2001 | Owens | |
| 6,575,549 | B1 | 6/2003 | Silverbrook | |
| 6,695,435 | B1 | 2/2004 | Cheng et al. | |
| 6,739,690 | B1 | 5/2004 | Darling | |
| 6,753,976 | B1 | 6/2004 | Torpey et al. | |
| 6,863,361 | B2 | 3/2005 | Barr et al. | |
| 6,868,180 | B2 | 3/2005 | Akahori et al. | |
| 6,880,907 | B2 | 4/2005 | Tsai | |
| 7,021,739 | B2 | 4/2006 | Burke et al. | |
| 7,075,677 | B1 | 7/2006 | Silverbrook | |
| 7,095,531 | B2 | 8/2006 | Mizes et al. | |
| 7,318,637 | B2 | 1/2008 | Ishimoto et al. | |
| 7,338,144 | B2 * | 3/2008 | Mantell et al. | 347/19 |
| 7,347,523 | B2 * | 3/2008 | Tatsumi | 347/19 |
| 7,484,830 | B2 | 2/2009 | Kim et al. | |
| 7,639,402 | B2 | 12/2009 | Vestjens et al. | |
| 7,731,342 | B2 | 6/2010 | Mantell | |

(Continued)

OTHER PUBLICATIONS

Dietz, Hank, "The Aggregate Magic Algorithms," http://aggregate.org/, Available on or before Jul. 11, 2004, University of Kentucky, Lexington, KY, USA (12 pages).

*Primary Examiner* — An Do
(74) *Attorney, Agent, or Firm* — Maginot, Moore & Beck, LLP

(57) ABSTRACT

A method of compensating for a defective inkjet in an inkjet printer has been developed. A controller identifies pixels in binary image data corresponding to the defective inkjet. The controller identifies alternative pixel locations for non-defective inkjets to print ink drops proximate to the locations of the defective pixels. When a total overlap parameter value identified in a region of image data around the pixels from the defective inkjet exceeds a predetermined value, the controller changes the alternative pixel location for at least one ink drop to reduce overlap and improve image quality.

20 Claims, 12 Drawing Sheets

(56) References Cited

U.S. PATENT DOCUMENTS

| | | | | |
|---|---|---|---|---|
| 7,815,274 | B2 | 10/2010 | De Waal | |
| 7,854,490 | B2 | 12/2010 | Snyder | |
| 7,866,778 | B2 | 1/2011 | Silverbrook et al. | |
| 7,887,154 | B2 * | 2/2011 | Vladislav | 347/19 |
| 7,903,290 | B2 | 3/2011 | Faken et al. | |
| 8,001,893 | B2 | 8/2011 | McCoy et al. | |
| 8,042,899 | B2 | 10/2011 | Folkins et al. | |
| 2003/0053161 | A1 | 3/2003 | Li et al. | |
| 2003/0169442 | A1 | 9/2003 | Yokochi | |
| 2003/0218780 | A1 | 11/2003 | Braun et al. | |
| 2004/0196320 | A1 | 10/2004 | Walmsley et al. | |
| 2005/0105105 | A1 | 5/2005 | Vestjens et al. | |
| 2005/0110817 | A1 | 5/2005 | Burke et al. | |
| 2005/0116981 | A1 | 6/2005 | Faken et al. | |
| 2005/0146543 | A1 | 7/2005 | Smith et al. | |
| 2005/0285897 | A1 | 12/2005 | Temple | |
| 2006/0007497 | A1 | 1/2006 | Yokochi | |
| 2006/0125850 | A1 | 6/2006 | Kim et al. | |
| 2006/0279591 | A1 | 12/2006 | Lee | |
| 2006/0285131 | A1 | 12/2006 | Mantell et al. | |
| 2007/0273927 | A1 | 11/2007 | Misaizu et al. | |
| 2009/0315939 | A1 | 12/2009 | Mantell et al. | |
| 2010/0245454 | A1 | 9/2010 | Ramakrishnan et al. | |

* cited by examiner

SYSTEM AND METHOD OF COMPENSATING FOR DEFECTIVE INKJETS WITH CONTEXT DEPENDENT IMAGE DATA

TECHNICAL FIELD

This disclosure relates generally to printers that eject ink from inkjets onto an image receiving surface and, more particularly, to printers that compensate for inkjets that are unable to eject ink to form a pixel on the image receiving surface.

BACKGROUND

Drop on demand inkjet technology for producing printed media has been employed in commercial products such as printers, plotters, and facsimile machines. Generally, an inkjet image is formed by selectively ejecting ink drops from a plurality of inkjets, which are arranged in one or more printheads, onto an image receiving surface. In a direct inkjet printer, the printheads eject ink drops directly onto the surface of a print medium such as a paper sheet or a continuous paper web. In an indirect inkjet printer, the printheads eject ink drops onto the surface of an intermediate image receiving member such as a rotating imaging drum or belt. During printing, the printheads and the image receiving surface move relative to one other and the inkjets eject ink drops at appropriate times to form an ink image on the image receiving surface. A controller in the printer generates electrical signals, also known as firing signals, at predetermined times to activate individual inkjets in the printer. The ink ejected from the inkjets can be liquid ink, such as aqueous, solvent, oil based, UV curable ink or the like, which is stored in containers installed in the printer. Alternatively, some inkjet printers use phase change inks that are loaded in a solid form and delivered to a melting device. The melting device heats and melts the solid phase change ink to a liquid form that is supplied to a printhead for printing as liquid drops onto the image receiving surface.

During the operational life of these printers, inkjets in one or more printheads may become unable to eject ink or to eject ink drops of an appropriate mass in response to a firing signal. These inkjets are described as defective inkjets in this document. The defective condition of the inkjet may be temporary and the inkjet may return to operational status after one or more image printing cycles. In other cases, the inkjet may not be able to eject ink until a purge cycle is performed. In a purge cycle, a pressure source is applied to an ink supply to the inkjets of a printhead to purge ink through the inkjets and clear some or all of the clogged inkjets in the printhead. Execution of a purge cycle, however, requires the printer to be taken out of its image generating mode. Thus, purge cycles affect the throughput of a printer and are typically performed during periods in which the printer is not generating ink images.

Existing methods enable a printer to generate images even though one or more inkjets in the printer is defective. These methods cooperate with image rendering methods to control the generation of firing signals for inkjets in a printhead. Rendering refers to the processes that receive input image data values and then generate output image values. The output image values are used to generate firing signals for a printhead to cause the inkjets to eject ink onto the image receiving surface in a pattern that corresponds to the input image data values. Once the output image values are generated, a defective inkjet compensation method uses information regarding which inkjets in a printhead are defective to identify the output image values that correspond to a defective inkjet in a printhead. The method then searches to find neighboring or nearby output image values that can be adjusted to compensate for the defective inkjet. In one embodiment, a printer controller increases the amount of ink ejected near the defective inkjet by ejecting ink drops from other inkjets that are proximate to the defective inkjet. These compensating ink drops are directed to locations of the ink image that would otherwise be blank. Thus, an output image value can be stored at an empty image value location to enable an inkjet to eject a compensating ink drop at the location. By firing an otherwise unused nearby inkjet in this manner, the ejected ink density in the vicinity of the defective inkjet can approximate the ink mass that is missing because of the defective inkjet.

Existing compensation methods for re-distributing the ink to be ejected by a defective inkjet to other neighboring or nearby inkjets decrease the perceived error due to the missing inkjet, but under some circumstances the existing compensation methods can increase the perceptibility of image defects generated by defective inkjets. For example, when the neighboring inkjets operate at an increased rate to compensate for the defective inkjet, then the neighboring inkjets can generate an uneven density of ink near the defective inkjet when compared to the surrounding region of the ink image. In some cases, the uneven ink density increases, rather than decreases, the perceptibility of the defective inkjet in the ink image. Consequently, defective inkjet compensation methods that enable more selective placement of the ink used to compensate for a defective inkjet would be beneficial.

SUMMARY

In one embodiment, a method of compensating for a defective inkjet in a printer has been developed. The method includes identifying a pixel in image data to be printed by an inoperable inkjet in a plurality of inkjets, identifying a first overlap parameter corresponding to the identified pixel and a plurality of pixels in the image data within a predetermined distance of the identified pixel, each pixel in the plurality of pixels to be printed by at least one inkjet in the plurality of the inkjets that is proximate to the inoperable inkjet, identifying a first location in the image data for storage of a compensation pixel corresponding to the pixel to be printed by the inoperable inkjet, the first location being identified with reference to a predetermined sequence of pixel locations positioned about the pixel to be printed by the inoperable inkjet, resetting the pixel to be printed by the inoperable inkjet, identifying a second overlap parameter corresponding to the plurality of pixels in the image data within the predetermined distance of the identified pixel, and storing the compensation pixel in a second location in the image data in response to a difference between the first overlap parameter and the second overlap parameter exceeding a predetermined threshold, the second location being a position in the predetermined sequence that is further from the pixel to be printed by the inoperable inkjet than the first location is from the pixel to be printed by the inoperable inkjet.

In another embodiment, a method of compensating for a defective inkjet in a printer has been developed. The method includes identifying a pixel in image data to be printed by an inoperable inkjet in a plurality of inkjets, identifying an overlap parameter corresponding to a plurality of pixels in the image data that are within a predetermined distance of the identified pixel to be printed by the inoperable inkjet, incrementing a total overlap value by the identified overlap parameter, resetting the pixel to be printed by the inoperable inkjet, identifying a first location in the image data for storage of a compensation pixel corresponding to one of the plurality of pixels to be printed by the inoperable inkjet, the first location being identified with reference to a predetermined sequence of pixel locations positioned about the pixel to be printed by the inoperable inkjet, and storing the compensation pixel in a second location in the image data in response to the total overlap value exceeding a predetermined threshold, the second location being a position in the predetermined sequence that is further from the identified pixel that the first location is from the identified pixel.

In another embodiment, an inkjet printer that compensates for a defective inkjet has been developed. The printer includes a plurality of operable inkjets and an inoperable inkjet, each one of the operable inkjets being configured to eject ink onto an image receiving surface, a memory configured to store image data, a total overlap value, and a plurality of overlap parameter values, and a controller operatively connected to the memory and the plurality of operable inkjets and the inoperable inkjet. The controller is configured to identify a pixel in the image data to be printed by the inoperable inkjet, identify an overlap parameter stored in the memory that corresponds to a plurality of pixels in the image data that are within a predetermined distance of the identified pixel, increase the total overlap value stored in the memory by the identified overlap parameter, reset the identified pixel, identify a first location in the image data for storage of a compensation pixel corresponding to one of the pixels within the predetermined distance from the identified pixel, the first location being identified with reference to a predetermined sequence of pixel locations positioned about the identified pixel, and store the compensation pixel in a second location in the image data in the memory in response to the total overlap value exceeding a predetermined threshold, the second location being a position in the predetermined sequence that is further from the identified pixel than the first location is from the identified pixel.

BRIEF DESCRIPTION OF THE DRAWINGS

The foregoing aspects and other features of a printer that enable compensation for defective inkjets are explained in the following description, taken in connection with the accompanying drawings.

DETAILED DESCRIPTION

Figure 1:
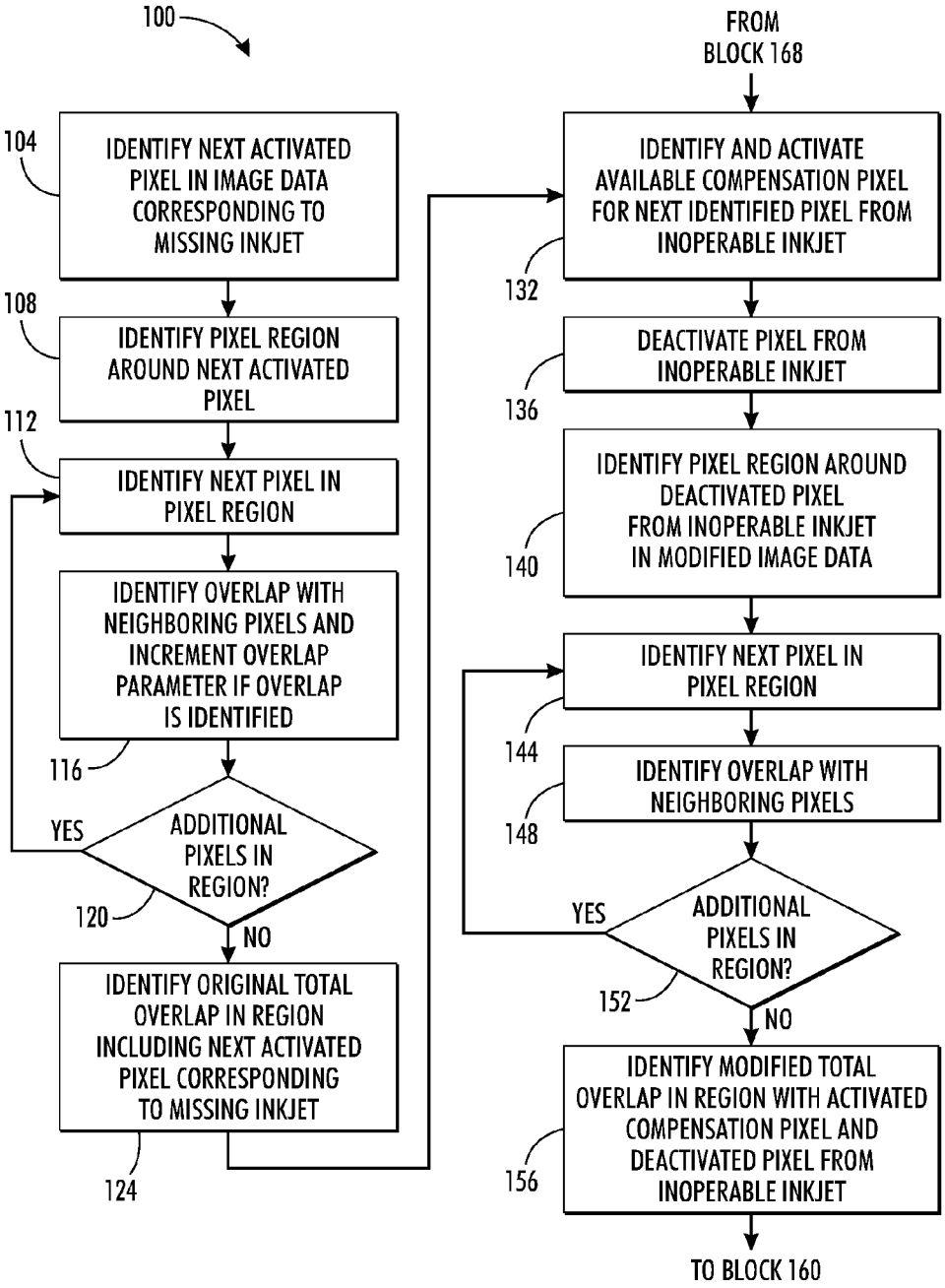
FIG. 1 is a block diagram of a process for modifying image data prior to operating inkjets in an inkjet printer to compensate for an inoperable inkjet.
Figure 1:
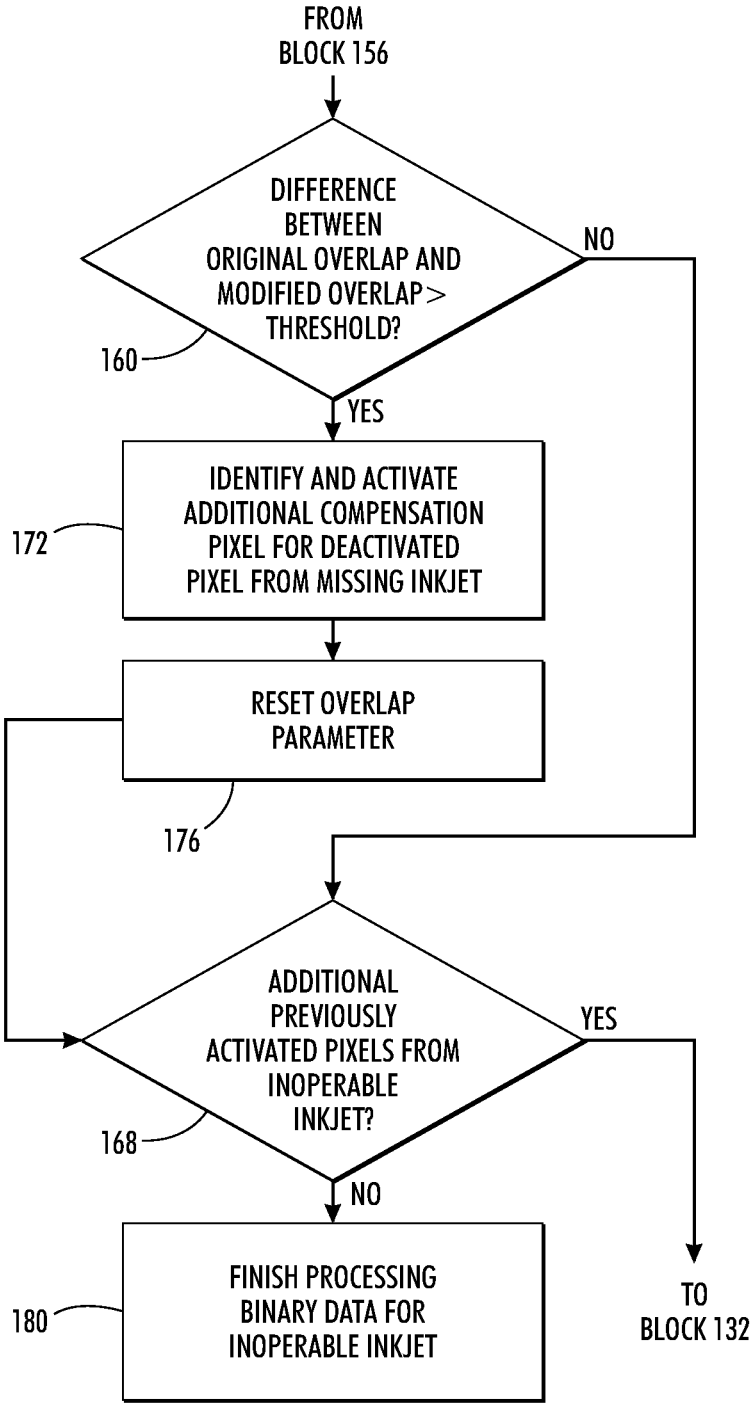

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, etc.

As used herein, the term "inoperable inkjet" refers to a malfunctioning inkjet in a printer that does not eject ink drops, ejects ink drops only on an intermittent basis, or ejects ink drops onto an incorrect location of an image receiving member when the inkjet receives an electrical firing signal. A typical inkjet printer includes a plurality of inkjets in one or more printheads, and operational inkjets that are located near the inoperable inkjet can compensate for the inoperable inkjet to preserve the quality of printed images when an inkjet becomes inoperable.

As used herein, the term "pixel" refers to a single value in a two-dimensional arrangement of image data corresponding to an ink image that an inkjet printer forms on an image receiving surface. The locations of pixels in the image data correspond to locations of ink drops on the image receiving surface that form the ink image when multiple inkjets in the printer eject ink drops with reference to the image data. An "activated pixel" refers to a pixel in the image data wherein the printer ejects a drop of ink onto an image receiving surface location corresponding to the activated pixel. A "deactivated pixel" refers to a pixel in the image data having a value where the printer does not eject a drop of ink onto an image receiving surface location corresponding to the deactivated pixel. The term "binary image data" refers to image data formed as a two-dimensional arrangement of activated and deactivated pixels. Each pixel in the binary image data has one of two values indicating that the pixel is either activated or deactivated. An inkjet printer forms ink images by selectively ejecting ink drops corresponding to the activated pixels in the image data. A multicolor printer ejects ink drops of different ink color with reference to separate sets of binary image data for each of the different colors to form multicolor ink images.

Binary image data are often arranged in a two-dimension array with dimensions that correspond to the process direction and cross-process direction during a print job. As used herein, the term "pixel column" refers to an arrangement of pixels in image data that extend in the process direction P. Since the image receiving surface moves past the inkjets in a print zone in the process direction P, if an inkjet is inoperable, then the inkjet cannot eject the ink drops corresponding to activated pixels in a pixel column that is aligned with the inoperable inkjet in the print zone. As described below, the printer activates additional pixels in the image data for inkjets that are proximate to the inoperable inkjet in the cross-process direction to reduce or eliminate defects in the printed images that are formed with the inoperable inkjet.

As used herein, the term "overlap" refers to a situation where two or more ink drops each cover a single location on the image receiving surface. An amount of overlap refers to a size of one or more areas of the image receiving member that are covered by multiple ink drops, or to a number of ink drops that partially or completely overlap each other on a print medium at the end of an imaging process. The overlap typically occurs when nearby ink drops and merge together on the image receiving surface. The spreading can occur during a transfixing operation in an indirect inkjet printer or during a spreading operation for ink drops on a print medium in a direct inkjet printer. When two or more nearby ink drops spread and overlap on the print medium, the total area of the print medium that is covered with ink is less than if the same ink drops had been spread without overlapping. As used herein, the term "overlap parameter" refers to a numeric value that is generated with reference to the overlap between ink drops on the print medium. The overlap parameter can be identified prior to printing the image with reference to the arrangement of activated pixels in the image data.

In some configurations, a printer measures overlap with reference to separate colors. For example, in a multi-color printer, two cyan ink drops that spread into the same location on the image receiving surface overlap, but a cyan ink drop and a yellow ink drops that occupy the same location are not considered to overlap. A controller in a printer can estimate the overlap between ink drops with reference to image data of the printed image prior to forming printed ink image.

As used herein, the term "image density" refers to a number of pixels in either image data or an ink image that receive ink drops. In a high density region, a comparatively large portion of the pixels are activated and the corresponding region of the image receiving surface receives a correspondingly large number of ink drops. In a low density region, fewer pixels are activated and the corresponding region of the image receiving surface receives fewer ink drops.

Figure 8:
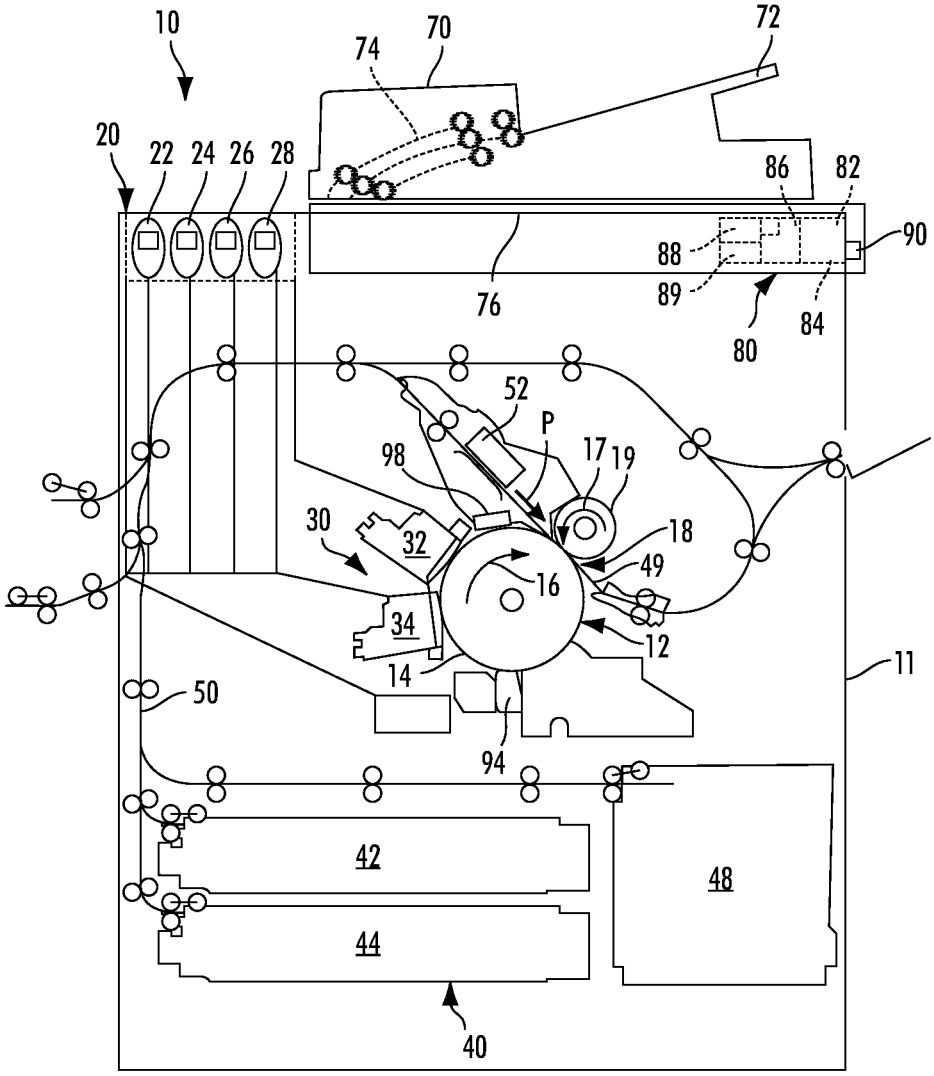
FIG. 8 PRIOR ART
FIG. 8 is a schematic view of a prior art inkjet printer.

FIG. 8 depicts an embodiment of a prior art printer 10 that can be configured to compensate for one or more inoperable inkjets. As illustrated, the printer 10 includes a frame 11 to which is mounted directly or indirectly all its operating subsystems and components, as described below. The phase change ink printer 10 includes an image receiving member 12 that is shown in the form of a rotatable imaging drum, but can equally be in the form of a supported endless belt. The imaging drum 12 has an image receiving surface 14, which provides a surface for formation of ink images. An actuator 94, such as a servo or electric motor, engages the image receiving member 12 and is configured to rotate the image receiving member in direction 16. A transfix roller 19 rotatable in the direction 17 loads against the surface 14 of drum 12 to form a transfix nip 18 within which ink images formed on the surface 14 are transfixed onto a heated print medium 49.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34. In the example of FIG. 8, both of the printhead assemblies 32 and 34 receive the melted CMYK ink from the ink sources 22-28. In another embodiment, the printhead assemblies 32 and 34 are each configured to print a subset of the CMYK ink colors.

The phase change ink printer 10 includes a substrate supply and handling subsystem 40. The substrate supply and handling subsystem 40, for example, includes sheet or substrate supply sources 42, 44, 48, of which supply source 48, for example, is a high capacity paper supply or feeder for storing and supplying image receiving substrates in the form of a cut sheet print medium 49. The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

Media sources 42, 44, 48 provide image receiving substrates that pass through media transport path 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the print medium 49 within the transfix nip 18. In a duplexed configuration, the media transport path 50 passes the print medium 49 through the transfix nip 18 a second time for transfixing of a second ink image to a second side of the print medium 49.

Operation and control of the various subsystems, components and functions of the printer 10 are performed with the aid of a controller or electronic subsystem (ESS) 80. The ESS or controller 80, for example, is a self-contained, dedicated mini-computer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data flow associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions, for example, printhead operation. The instructions and data required to perform the programmed functions are stored in the memory 84 that is associated with the processors or controllers. The processors, their memories, and interface circuitry configure the printer 10 to form ink images, and, more particularly, to control the operation of inkjets in the printhead assemblies 32 and 34 to compensate for inoperable inkjets. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

In operation, the printer 10 ejects a plurality of ink drops from inkjets in the printhead assemblies 32 and 34 onto the surface 14 of the image receiving member 12. The controller 80 generates electrical firing signals to operate individual inkjets in one or both of the printhead assemblies 32 and 34. In the multi-color printer 10, the controller 80 processes digital image data corresponding to one or more printed pages in a print job, and the controller 80 generates two dimensional bit maps for each color of ink in the image, such as the CMYK colors. Each bit map includes a two dimensional arrangement of pixels corresponding to locations on the image receiving member 12. Each pixel has one of two values indicating if the pixel is either activated or deactivated. The controller 80 generates a firing signal to activate an inkjet and eject a drop of ink onto the image receiving member 12 for the activated pixels, but does not generate a firing signal for the deactivated pixels. The combined bit maps for each of the colors of ink in the printer 10 generate multicolor or monochrome images that are subsequently transfixed to the print medium 49. The controller 80 generates the bit maps with selected activated pixel locations to enable the printer 10 to produce multi-color images, half-toned images, dithered images, and the like.

During a printing operation, one or more of the inkjets in the printhead assemblies 32 and 34 may become inoperable. An inoperable inkjet may eject ink drops on an intermittent basis, eject ink drops onto an incorrect location on the image receiving surface 14, or entirely fail to eject ink drops. In the printer 10, an optical sensor 98 generates image data corresponding to the ink drops that are printed on the image receiving surface 14 after formation of the ink images and prior to the imaging drum 12 rotating through the nip 18 to transfix the ink images. In one embodiment, the optical sensor 98 includes a linear array of individual optical detectors that detect light reflected from the image receiving surface. The individual optical detectors each detect an area of the image receiving member corresponding to one pixel on the surface of the image receiving member in a cross-process direction, which is perpendicular to the process direction P. The optical sensor 98 generates digital data, referred to as reflectance data, corresponding to the light reflected from the image receiving surface. The controller 80 is configured to identify inoperable inkjets in the printhead assemblies 32 and 34 with reference to the reflectance values detected on the imaging receiving surface 14 and the predetermined image data of the printed ink images. In an alternative embodiment, an optical sensor detects defects in ink images after the ink images have been formed on the print medium 49. In another alternative embodiment, the inoperable inkjets are identified with sensors located in the printhead assemblies. In response to identifying an inoperable inkjet, the controller 80 ceases generation of firing signals for the inoperable inkjet, and generates firing signals for other inkjets that are proximate the inoperable inkjet in the printer to compensate for the inoperable inkjet.

The printer 10 is an illustrative embodiment of a printer that compensates for inoperable inkjets using the processes described herein, but the processes described herein can compensate for inoperable inkjets in alternative inkjet printer configurations. For example, while the printer 10 depicted in FIG. 8 is configured to eject drops of a phase change ink, alternative printer configurations that form ink images using different ink types including aqueous ink, solvent based ink, UV curable ink, and the like can be operated using the processes described herein. Additionally, while printer 10 is an indirect printer, printers that eject ink drops directly onto a print medium can be operated using the processes described herein.

FIG. 1 depicts a process 100 for modifying binary image data to reduce or eliminate the perceptibility of an inoperable inkjet in printed images. In the description below, a reference to the process 100 performing or doing some function or action refers to one or more controllers or processors that are configured with programmed instructions to implement the process performing the function or action or operating one or more components to perform the function or action. Process 100 is described with reference to the printer 10 of FIG. 8 for illustrative purposes.

Process 100 begins with identification of the next pixel in the binary image data for a printed image that corresponds to a missing inkjet and that is activated. For example, FIG. 3A-FIG. 3D depicts a two-dimensional array of binary image data arranged in pixels. Each pixel in the image array has a numeric value of zero or one, with zero indicating that the pixel is deactivated and one indicating that the pixel is activated in the embodiments of FIG. 3A-FIG. 3D. FIG. 3A-FIG. 3D also depict ink drops that are superimposed on the image data to illustrate the effects of overlap between ink drops in the image that is formed from the binary image data.

Figure 3A:
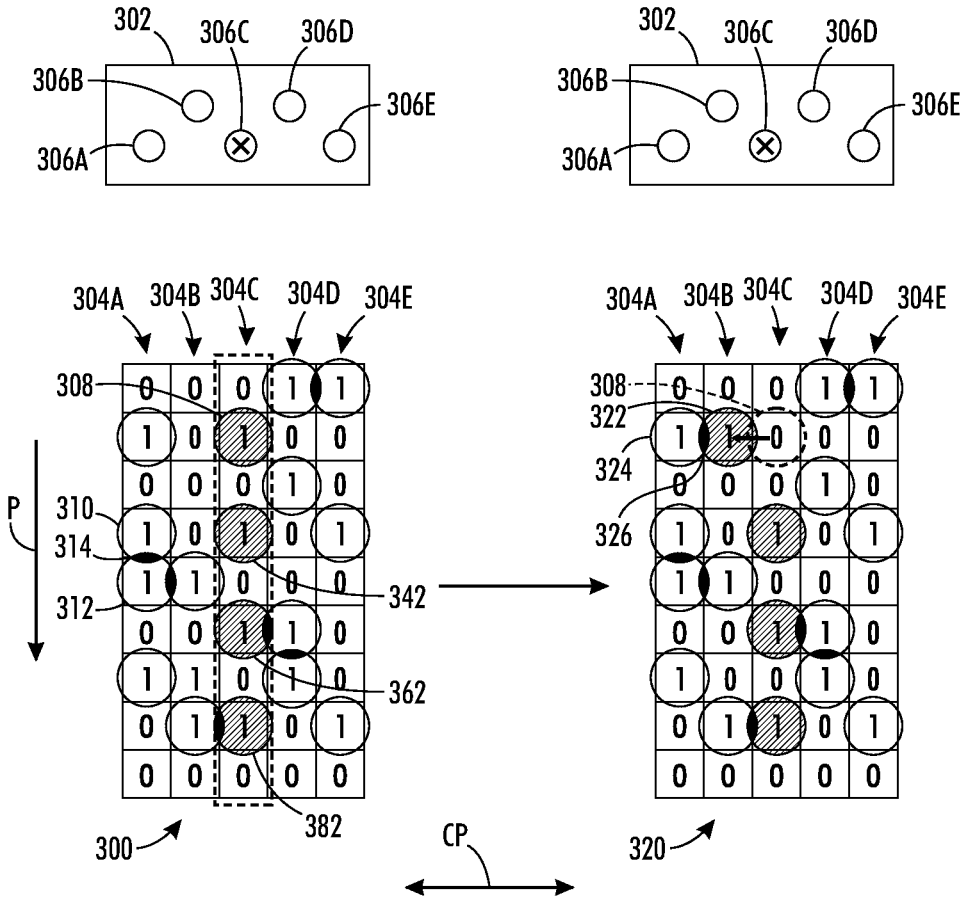
FIG. 3A is a diagram depicting image data and ink drops that are formed by a printer corresponding to the image data including a column of image data corresponding to an inoperable inkjet.
Figure 3B:
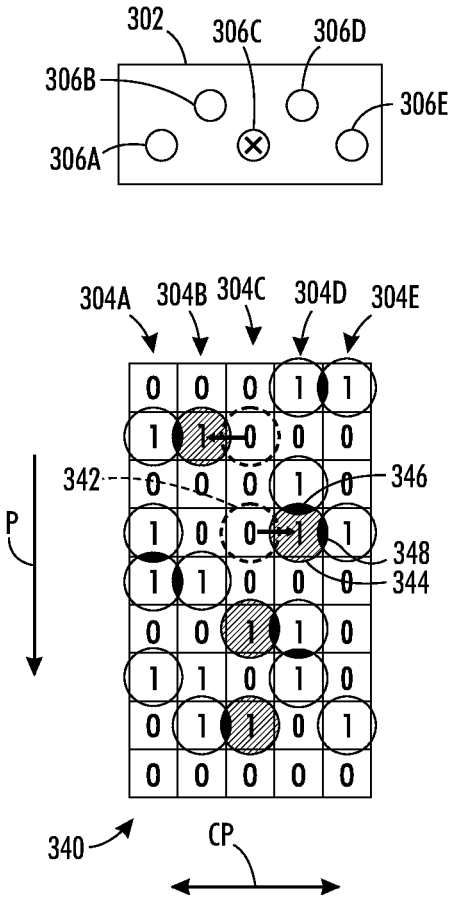
FIG. 3B is another diagram depicting the image data and ink drops in of FIG. 3A after compensation of a pixel corresponding to the inoperable inkjet.

In FIG. 3A, the image data 300 include pixel columns 304A, 304B, 304C, 304D, and 304E. Each of the pixel columns 304A-304E includes a plurality of pixels that extend in the process direction P. The pixel columns are arranged in the cross-process direction CP to form a two-dimensional array of image data. Each one of the pixel columns 304A-304E corresponds to a single inkjet in a printhead, such as the simplified printhead 302 with inkjets 306A-306E that correspond to the pixel columns 304A-304E, respectively. In the CMYK printer 10, the controller 80 generates four sets of binary image data including an array of pixels similar to the image data 300 for each one of the cyan, magenta, yellow, and black color separations. During a printing operation, the printer 10 forms multicolor images with different combinations of ink drops from each of the CMYK inks.

In FIG. 3A, the inkjet 306C in the printhead 302 is inoperable. The corresponding pixel column 304C includes image data that correspond to the inoperable inkjet 306C. Thus, the activated pixels in the pixel column 304C in FIG. 3A cannot be printed during the print job. During process 100, the controller 80 modifies the binary image data to activate additional pixels in neighboring inkjets to compensate for the inoperable inkjet. Additionally, the controller 80 identifies changes in overlap between the ink drops corresponding to activated pixels and activates additional pixels where required to reduce or eliminate perceptual changes in the image due to changes in the overlap between ink drops that are due to the activation of additional pixels in the image data.

Referring to FIG. 1 and FIG. 3A, the controller 80 proceeds through the pixel column 304C and identifies an activated pixel 308 that corresponds to the inoperable inkjet (block 104). The controller 80 also identifies a region of image data surrounding the activated pixel 308 (block 108). In the simplified embodiment of FIG. 3A the region includes each of the neighboring pixels around the pixel 308 that are depicted in FIG. 3A. In another embodiment, the region is typically a rectangular grid of pixels in the image data that is centered about the activated pixel of the inoperable inkjet. For example, the controller 80 identifies a 7×9 pixel region of 63 pixels centered about the identified activated pixel for the inoperable inkjet.

Process 100 continues as the controller 80 iterates through each of the pixels in the identified region around the activated pixel identified for the inoperable inkjet to identify overlap between ink drops that correspond to the activated pixels in the region. The controller 80 identifies a pixel in the region (block 112), identifies overlap between the pixel and neighboring pixels in the region and increments an overlap parameter if necessary (block 116), and continues in an iterative manner for each pixel in the region (block 120). In one embodiment, after identifying an overlap between two pixels the controller 80 ignores the same overlap when processing the second pixel in the pair. For example, if the controller 80 processes pixel 310 and identifies the overlap 314 between the pixel 310 and the pixel 312, then the controller 80 subsequently ignores the overlap 314 when identifying overlap between the pixel 312 and other neighboring pixels. The controller 80 identifies a total overlap parameter for the region as, for example, the sum of the individual overlap parameters identified for each of the pixels in the region (block 124).

In one embodiment, the overlap parameter is a numeric value corresponding to the number of expected overlaps between pixels in the identified region, including activated pixels that correspond to the inoperable inkjet. For example, in FIG. 3A activated pixels in the binary image data that are immediately adjacent to each other in the process direction P or cross-process direction CP are considered to overlap. In FIG. 3A, the arrangement of activated pixels in the image data 300 includes a total of six (6) overlapping pixels, and the overlap parameter corresponds to the number of overlapping pixels. FIG. 3A depicts the overlap between the ink drops corresponding to the pixels, such as overlapping region 312 between the pixels 310 and 311. The controller 80 stores the identified overlap parameter for the region in a memory, such as the memory 84, for later identification of deviations from the number of overlaps in the region of image data around the pixel column corresponding to the inoperable inkjet.

Process 100 continues with a pixel compensation operation that modifies the binary image data to compensate for the activated pixel that corresponds to the inoperable inkjet. During the pixel compensation operation, the controller 80 identifies and activates a deactivated pixel in the image data in a pixel column that is different than the pixel column of the inoperable inkjet (block 132), and deactivates the activated pixel for the inoperable inkjet (block 136). For example, referring again to FIG. 3A, the image data 320 include a newly activated pixel 322 in the pixel column 304B that corresponds to the operational inkjet 304B in the printhead 302. The activated pixel 322 is referred to as an "adoption site" that adopts the pixel 308 that is "orphaned" because the inkjet 306C is inoperable. The operational inkjet 306B is offset from the inoperable inkjet 306C in the cross-process direction CP, but the offset between the activated pixel 322 and the deactivated pixel 308 is small enough that the activated pixel 322 compensates for the missing pixel 308 in the printed image.

Figure 7A:
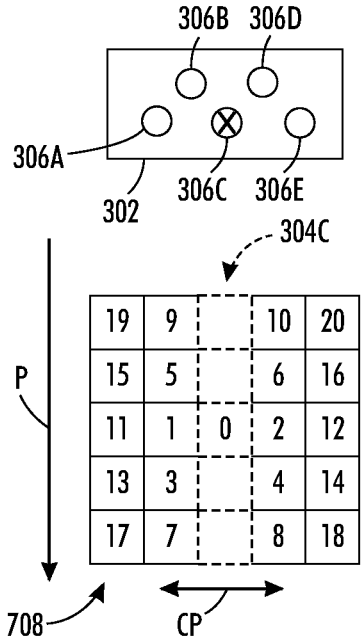
FIG. 7A is a diagram depicting a search pattern for finding a compensation pixel to compensate for an inoperable inkjet.
Figure 7B:
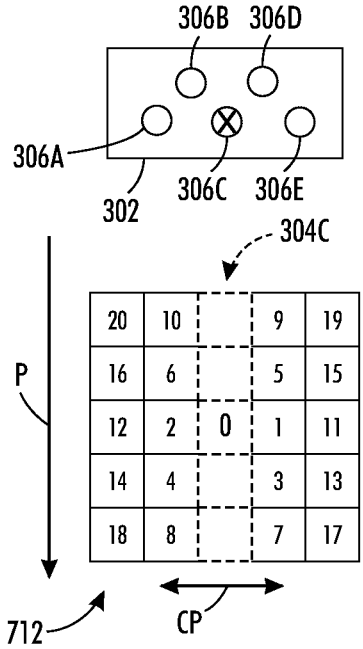
FIG. 7B is a diagram depicting another search pattern for finding a compensation pixel to compensate for an inoperable inkjet.

During process 100, the controller 80 identifies the location of the adoption site pixel 322 using one or more search patterns that search for deactivated pixels in the pixel columns of image data around the orphaned pixel 308. FIG. 7A and FIG. 7B depict two examples of search patterns 708 and 712, respectively. In both search patterns 708 and 712, the orphan pixel is placed at the center of the search pattern and labeled with a 0. The search patterns 708 and 712 exclude the pixel column 304C, which corresponds to the inoperable inkjet 306C, and assign numeric values to the surrounding pixels in order of priority, with the lower numbers having highest priority. In the examples of FIG. 7A and FIG. 7B, the search patterns 708 and 712 are similar to each other, but the search pattern 712 is inverted from the search pattern 708 around the process direction axis through the pixel column 304C.

During the process 100, the controller 80 uses either or both of the search patterns 708 and 712, or other similar search patterns, to identify a pixel in the image data to compensate for the pixel corresponding to the inoperable inkjet. The controller 80 searches neighboring pixels around the orphan pixel in the order specified in the search patterns until identifying a neighboring pixel that is not already activated in the image data. The controller 80 then activates the identified pixel to compensate for the pixel corresponding to the inoperable inkjet, and deactivates the previously activated pixel to ensure that the inoperable inkjet does not receive firing signals during an imaging operation.

Once the new pixel is activated to compensate for the pixel corresponding to the inoperable inkjet, the total amount of overlap in the image data may change. In one example, in the original image data the orphan pixel corresponding to the inoperable inkjet is adjacent to one or more activated pixels, which correspond to overlap between the printed ink drops corresponding to the image data pixels. After activating the compensation pixel, however, the amount of overlap may decrease if the compensation pixel does not overlap with other pixels in the image data. In another example, the compensation pixel that is activated at the adoption site increases the total overlap instead of decreasing the overlap or maintaining the overlap. For example, as depicted in FIG. 3A, the image data 320 depict the deactivated pixel 308 that corresponds to the inoperable inkjet 306C, and the compensation pixel 322 is activated to compensate for the deactivated pixel 308. In the original image data, the pixel 308 does not overlap other pixels in the image data. In the modified image data 320, however, the compensation pixel 322 overlaps the pixel 324 as depicted by the overlap region 326.

To identify changes in the total overlap that are produced due to the activation of compensation pixels and deactivation of pixels that correspond to the inoperable inkjet, process 100 identifies the region around the deactivated pixel in the modified image data (block 140), and then iterates through each of the pixels in the region (block 144), identifies the overlap between the pixels in the region (block 148), and continues to identify overlap for each of the additional pixels in the region (block 152). In the printer 10, the controller 80 identifies the overlap for the pixels in the modified image data and identifies a modified total overlap parameter in the region including the activated compensation pixel in the adoption site and the deactivated pixel corresponding to the inoperable inkjet (block 156). The processing described with reference to blocks 140-156 is substantially similar to the processing described with reference to blocks 108-124, respectively, except that the processing in blocks 140-152 identifies the total overlap in the modified image data after activation of the compensation pixel and deactivation of the pixel corresponding to the inoperable inkjet. For example, in FIG. 3A, the controller 80 processes the pixels in the modified image data 320 to identify the total overlap parameter. In the modified image data, the controller 80 identifies the overlap parameter corresponding to a total of seven (7) regions of overlap, since the pixel 308 did not overlap other pixels while the activated compensation pixel 322 overlaps the pixel 324.

During process 100, the controller 80 identifies whether the difference between the overlap parameter corresponding to the modified image data and the overlap parameter identified for the original image data exceeds a predetermined threshold (block 160). In the illustrative example depicted in FIG. 1, the overlap difference threshold is four (4), meaning that the process 100 generates an additional compensation pixel in the image data if a difference in the overlap parameter for modified image compared to the overlap parameter in the original image data exceeds the predetermined threshold. For example, in FIG. 3A the controller 80 identifies an overlap parameter corresponding to six (6) overlapping pixels in the original image data 300, while the controller 80 identifies another overlap parameter with seven (7) overlapping pixels in the modified image data 320. The difference between the overlap parameter identified for the original image data and the modified image data is less than the predetermined threshold (block 160), and the process 100 continues for additional activated pixels in the pixel column 304C (block 168), to identify the next activated pixel in the pixel column 304C (block 104).

Figure 3C:
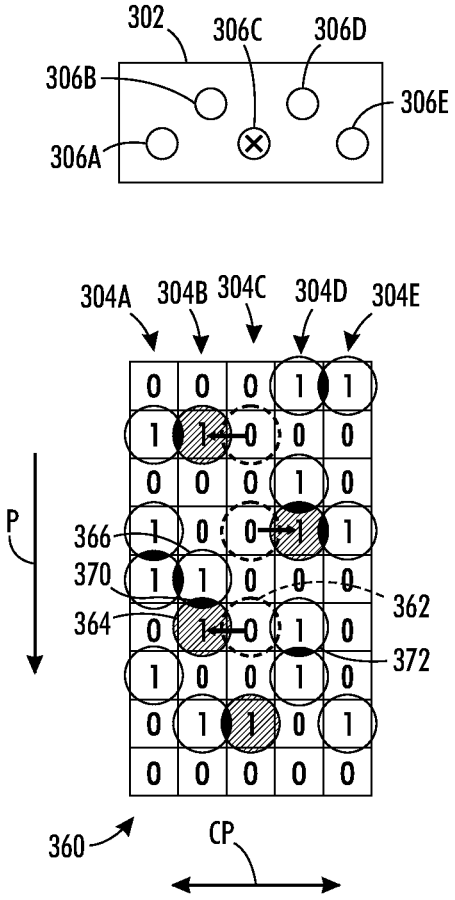
FIG. 3C is another diagram depicting the image data and ink drops in of FIG. 3A and FIG. 3B after compensation of another pixel corresponding to the inoperable inkjet.

Process 100 continues through the processing described above with reference to blocks 132-168 for additional activated pixels in the pixel column corresponding to the inoperable inkjet while the differences between the original overlap parameter and overlap parameters identified for modified image data remain below the predetermined threshold. For example, in FIG. 3B the controller 80 deactivates the orphan pixel 342 and activates the compensation pixel 344 in the modified image data 340. The controller 80 identifies a modified overlap parameter corresponding to a total of nine (9) overlapping regions in the modified image data 340, including overlap regions 346 and 348 between the compensation pixel 344 and neighboring pixels. In FIG. 3C, the controller 80 deactivates the orphaned pixel 362 and activates the compensation pixel 364 as depicted in the modified image data 360. In FIG. 3C, the compensation pixel 364 overlaps with pixel 366 in the overlap region 370. The orphan pixel 362, however, overlapped with the pixel 372 in the original image data. Thus, the controller 80 identifies the overlap parameter corresponding to nine (9) overlapping pixels in the image data 360 of FIG. 3C, which is the same overlap parameter identified in FIG. 3B.

During process 100, the overlap parameter for the modified image data may differ from the overlap parameter identified for the original image data by an amount that is greater than the predetermined threshold (block 160). For example, in FIG. 3D the controller 80 activates a compensation pixel 384 for the orphan pixel 382 in the modified image data 380. The compensation pixel 384 overlaps with pixels 386 and 388 in overlap regions 390 and 392, respectively. After activating the compensation pixel 384, the overlap parameter for the image data 380 corresponds to eleven (11) overlapping regions, while the original overlap parameter corresponds to six (6) overlapping pixels, for a difference of five (5) overlapping pixels between the two parameters.

Figure 3D:
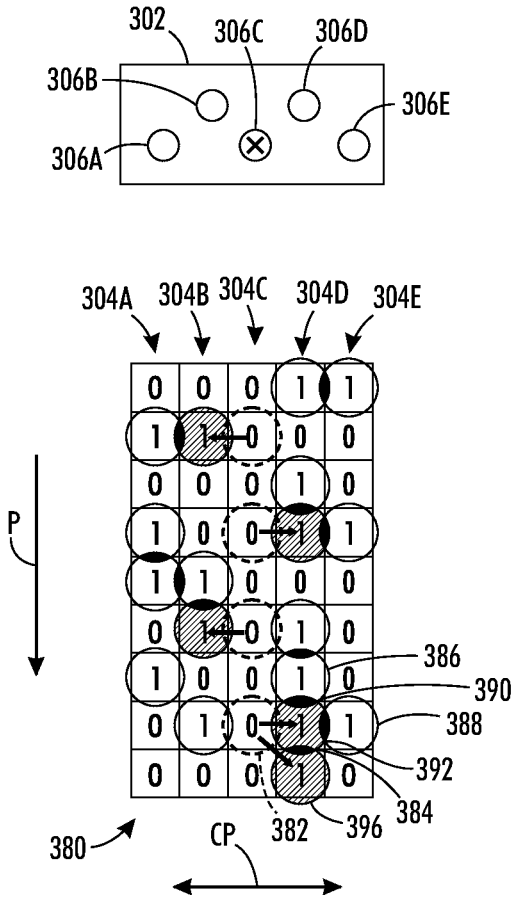
FIG. 3D is another diagram depicting the image data and ink drops in of FIG. 3A-FIG. 3C after compensation of another pixel corresponding to the inoperable inkjet and an additional compensation pixel to compensate for overlap between printed ink drops that correspond to the image data.

Since the difference of five (5) overlapping pixels in the example of FIG. 3D exceeds the predetermined threshold of four (4) overlapping pixels, the controller 80 identifies and activates an additional compensation pixel for the orphaned pixel that corresponds to the inoperable inkjet (block 172). To identify an additional compensation pixel, the controller 80 performs another search through the predetermined search pattern to identify another deactivated pixel that is proximate to the orphaned pixel. For example, in FIG. 3D the controller identifies the first compensation pixel 384 and the additional compensation pixel 396 using the search pattern 712 that is depicted in FIG. 7B. The controller 80 then resets the original overlap parameter to correspond to the overlap identified in the modified image data, such as the overlap parameter corresponding to eleven (11) overlap pixels in FIG. 3D (block 176). The controller 80 resets the overlap parameter so that the process 100 can continue to process additional pixels that correspond to the inoperable inkjet without generating two compensation pixels for each orphaned pixel. During process 100, the controller 80 generates pixel values to activate additional compensation pixels as needed if the accumulated differences in the total overlap parameter exceed the predetermined threshold for additional pixels in the image data.

As described above, overlap between printed ink drops decreases the total perceptible visibility of the printed ink because the overlapping regions between ink drops cover a smaller portion of a print medium that the ink drops would cover if printed without overlap on the print medium. The additional compensation pixel 396 and the ejected ink drop corresponding to the pixel 396 offset the effects of the increased overlap that is produced due to the compensation process for the inoperable inkjet 306C.

Process 100 continues as described above to compensate for activated pixels in the image data that correspond to the inoperable inkjet. After compensating for all of the pixels in the pixel column (block 168), the controller 80 finishes processing of the binary image data (block 180). In configurations where multiple inkjets in the printhead assemblies 32 and 34 are inoperable, the controller 80 performs process 100 for the binary image data corresponding to each of the inoperable inkjets. After processing the binary image data, the printer 10 prints the ink images using the modified binary image data to compensate for one or more inoperable inkjets.

Figure 2:
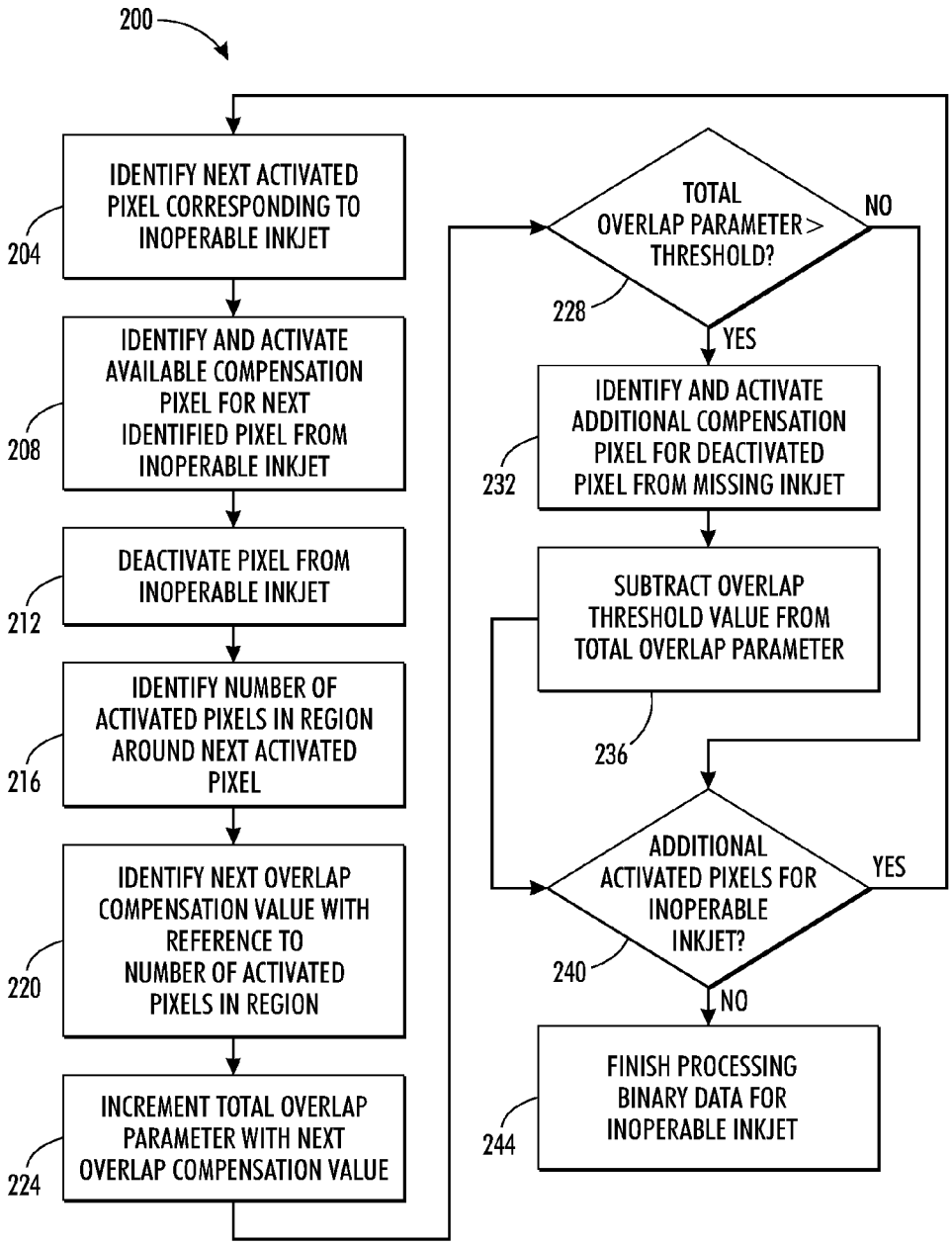
FIG. 2 is a block diagram of another process for modifying image data prior to operating inkjets in an inkjet printer to compensate for an inoperable inkjet.

The process 100 described above enables the printer to identify when to generate an additional compensation pixel in binary image data due to changes in the amount of overlap in ink drops that are incurred due to the compensation process for the inoperable inkjet. As described above, process 100 identifies a value for the overlap parameter using an iterative process that identifies the overlap parameter in the region surrounding each activated pixel for the inoperable inkjet with high precision. The iterative procedure for identifying the overlap parameter is, however, somewhat computationally intensive. FIG. 2 depicts an alternative process 200 that modifies image data to compensate for an inoperable inkjet. As described below, process 200 also identifies an overlap parameter in the image data and adjusts the image data to compensate for changes in the overlap between pixels, but the process 200 employs heuristics to perform the compensation process in a more computationally efficient manner than the process 100. In the description below, a reference to the process 200 performing or doing some function or action refers to one or more controllers or processors that are configured with programmed instructions to implement the process performing the function or action or operating one or more components to perform the function or action. Process 200 is described with reference to the printer 10 of FIG. 8 for illustrative purposes.

Process 200 begins with identification of an activated pixel in binary image data corresponding to the inoperable inkjet (block 204). For example, as described above the pixel column 304C in FIG. 3A-FIG. 3D corresponds to the inoperable inkjet 306C and the controller 80 identifies the next activated pixel, such as the pixel 308 that corresponds to the inoperable inkjet 306C.

Once the next active pixel is identified, the controller 80 identifies and activates a compensation pixel in the image data corresponding to an available pixel adoption site in the image data (block 208) and deactivates the identified pixel corresponding to the inoperable inkjet (block 212). For example, as depicted in the image data 320 in FIG. 3A the controller deactivates the pixel 308 and activates the compensation pixel 322 to compensate for the inoperable inkjet. The controller 80 performs the processing of blocks 208 and 212, which is the same as the processing described above with reference to blocks 132 and 136 in FIG. 1, respectively.

Figure 4:
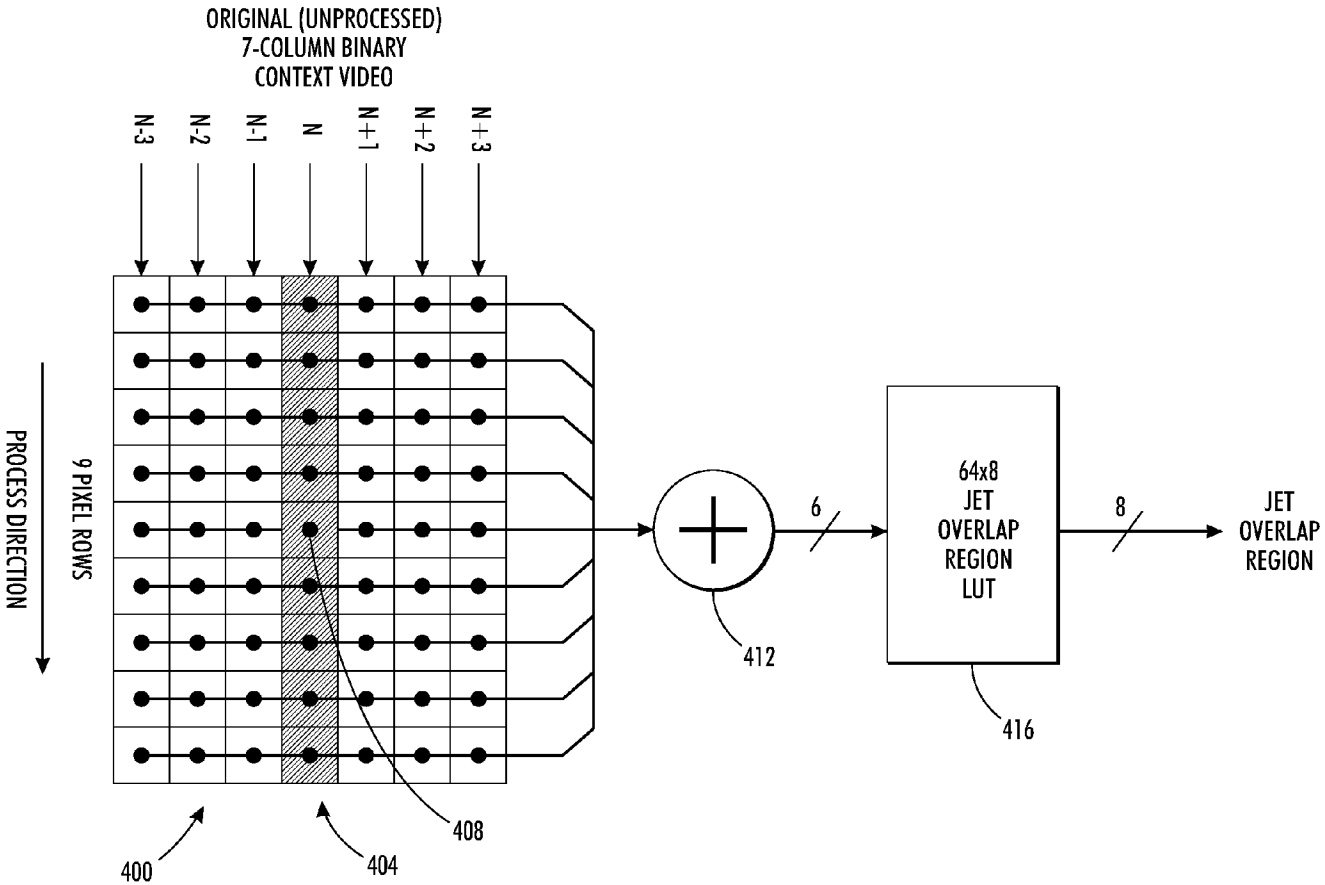
FIG. 4 is a schematic diagram depicting binary image data and a lookup table for finding an overlap compensation value with reference to a number of activated pixels in the binary image data.

After modifying the image data to activate the compensation pixel, process 200 continues as the controller 80 identifies a number of activated pixels in a predetermined region of image data surrounding the deactivated pixel corresponding to the inoperable inkjet (block 216). In one embodiment, the region includes a 7×9 rectangular array of pixels about the pixel for the inoperable inkjet. For example, as depicted in FIG. 4, the array of image data 400 includes the pixel column 404 corresponding to the inoperable inkjet and neighboring pixel columns. The controller 80 identifies the pixel 408 from the inoperable inkjet and activates a compensation pixel in the one of the pixels 400. In the image data 400, the controller 80 identifies the number of all the pixels in image data region 400 that are activated. In FIG. 4 a summing unit 412 sums count of activated pixels from the image data. The controller 80 employs a computationally efficient technique that is known to the art, including lookup tables with index corresponding to each possible combination of pixels in the pixel columns or efficient bit-counting algorithms, such as the variable-precision Single-Instruction Multiple-Data (SIMD) Within a Register (SWAR) algorithm, to identify the total number of bits that are activated in the image data 400.

During process 200, the controller 80 identifies an overlap compensation value that is retrieved from a lookup table (LUT) stored in the memory 84 using the number of activated pixels as an index to retrieve the overlap compensation value from the LUT (block 220). As depicted in FIG. 4, one embodiment of the LUT includes 64 entries with one entry for any possible combination of 0 to 63 activated pixels from the image data region 400. In the embodiment of FIG. 4, each entry in the LUT 416 is an 8-bit numeric value with a predetermined value of 0 to 255.

Figure 5:
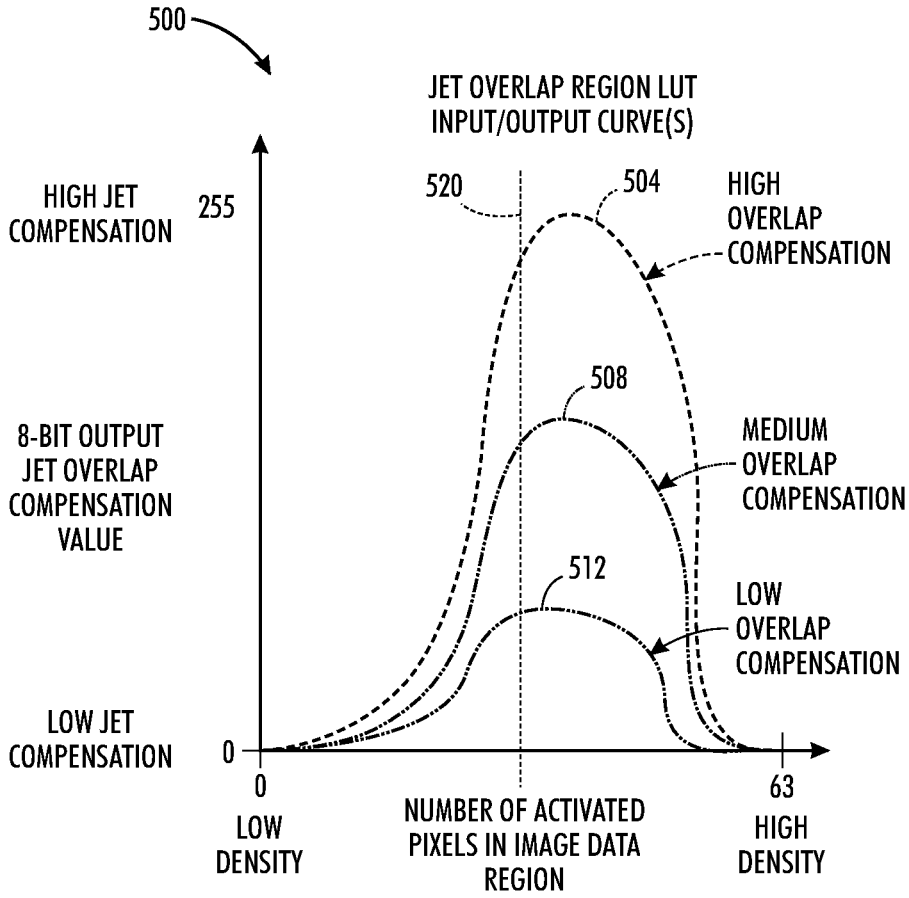
FIG. 5 is a graph depicting exemplary overlap compensation values stored in the lookup table of FIG. 4.

FIG. 5 is a graph 500 that depicts three different sets of LUT values graphed along curves 504, 508, and 512. The curve 504 corresponds to a high overlap compensation configuration for the process 200. The high overlap compensation means that the controller 80 is configured to activate additional compensation pixels in the image data to compensate for overlap with a greater frequency than that depicted in the curves 508 and 512. For example, at index 520 the curve 504 has the greatest overlap compensation value, which the controller 80 uses to identify when to activate an additional pixel in the image data to compensate for overlap between ink drops in the printed image. The curve 508 depicts a set of intermediate overlap compensation parameters, and the curve 512 depicts a set of low overlap compensation parameters. In one embodiment, the memory 84 stores data correspond to each of the curves 504, 508, and 512, and the controller 80 selects one set of overlap compensation data to be used in the LUT for each print job.

In one embodiment, a memory in a printer, such as the memory 84, stores data corresponding to one of the curves 504-512 depicted in FIG. 5 or another compensation curve. In another embodiment, the memory stores multiple curves, such as some or all of the curves 504-512 in FIG. 5. One method for generation of a compensation curve for a particular operating mode in a printer includes generation of image data from a printed image that includes a range of ink densities from 0% density to 100% density including the inoperable inkjet using an inoperable inkjet camouflage process that does not include the overlap compensation process that is described above. In a multi-color printer, the printer generates printed images with the full range of densities for each of the ink colors in the printer. An optical sensor in the printer generates scanned image data of the printed image including the region corresponding to the inoperable inkjet to identify a density profile of the region around the inoperable inkjet over the full range of printed ink densities. The controller compares the density profile data to the density profile of a similar "swath" (i.e. 7 pixel×9 pixel region) of the printed image that includes only operational inkjets. The difference between the density profiles generated for the inoperable inkjet and operational inkjets as a function of input density in the process direction corresponds to the amount of overlap compensation that provides the highest image quality when compensating for the inoperable inkjet. In the embodiment of FIG. 4, the profile data are stored within the 64×8 LUT 416 to include compensation values from full "white" (corresponding to address "0" of the LUT) to full "black" (corresponding to address "63" of the LUT).

The identified overlap compensation curves vary between different printer configurations and vary between different operating modes in a single printer. The overlap compensation data that are stored within the LUT vary for different printed image resolutions. For example, the controller 80 printer 10 selects a LUT including data corresponding to one of the predetermined overlap compensation curves 504-512 with reference to the resolution of a print job. In one embodiment, the overlap compensation curve data are generated for each resolution that the printer is configured to produce, and one overlap compensation curve is selected in each print job based on the predetermined resolution of the print job to camouflage the inoperable inkjet with the highest image quality.

As depicted in FIG. 5, each of the overlap compensation value curves 504-512 begins with small values for the region around the activated ink drop including a small number of activated pixels and rises to a peak as the number of activated pixels increases. The increase in the overlap compensation values in the LUT is due to an increase in the probability that pixels in the image data region around the identified pixel for the inoperable inkjet are more likely to overlap as the number of activated pixels in the region increases. In the graph 500, however, after reaching a peak, the overlap compensation values decline once the number of activated pixels increases past a threshold value. The threshold value can vary for different LUT embodiments, but is usually at approximately 50% density, which corresponds to 32 activated pixels in the embodiment of FIG. 5.

Figure 6:
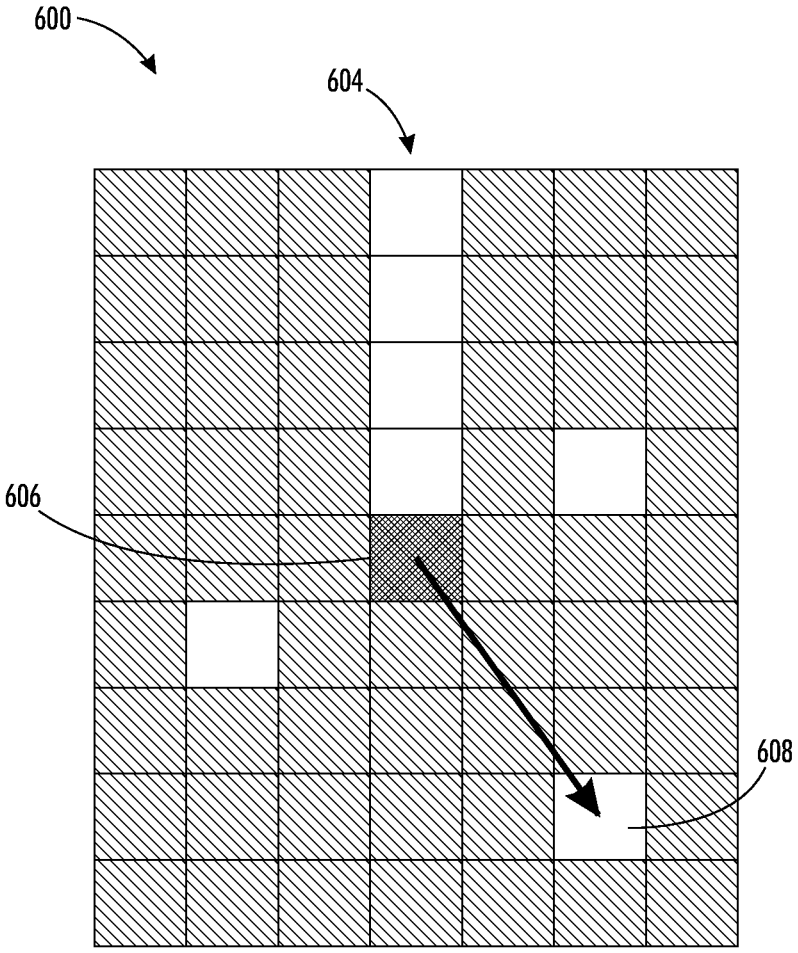
FIG. 6 is a diagram depicting a region of image data with a high density of active pixels around a pixel column corresponding to an inoperable inkjet.

The reason for the decrease in the overlap compensation parameters in the LUT is that the effect of pixel overlap on the perceptible printed ink images declines as the density of printed ink drops passes the threshold density. For example, as depicted in FIG. 6, the image data 600 surrounding a pixel column 604 corresponds to an inoperable inkjet. In the image data 600, most of the pixels are activated before the process 200 identifies compensation pixels, such as the pixel 608, for the activated pixels in the pixel column 604, such as the orphaned pixel 606. While the ink drop that is printed for the compensation pixel 608 overlaps surrounding pixels, the original pixel 606 corresponding to the inoperable inkjet also overlaps neighboring pixels in the image data, and the image data generate a printed image in which ink covers a large proportion of the print medium in the region around the pixel column 604. Thus, in the high-density region of printed image, the effect of overlap is reduced because a large portion of the surface of the media sheet is covered with ink regardless of the number of additional ink drops that are printed to compensate for the inoperable inkjet.

Referring again to FIG. 2, after identifying the overlap compensation value from the LUT, the controller 80 increments the total overlap parameter with the overlap compensation value (block 224). During process 200, the controller 80 stores the total overlap parameter in the memory 84 and increments the overlap parameter after activating the compensation pixel for each activated pixel in the image data that corresponds to the inoperable inkjet. If the value of the total overlap parameter remains below a predetermined threshold (block 228), then the controller 80 identifies the next active pixel in the pixel column corresponding to the inoperable inkjet (block 240) and returns to the processing described above with reference to block 204 to generate a compensation pixel for additional active pixels in the pixel column, such as the pixels 342, 362, and 382 that are depicted in FIG. 3A-FIG. 3D.

During process 200, if the total overlap parameter exceeds the predetermined threshold (block 228), then the controller 80 identifies and activates an additional compensation pixel in the binary image data to compensate for the accumulated overlap identified in the surrounding image data (block 232). In the printer 10, the controller 80 performs a search for another available pixel in the predetermined search pattern and activates the pixel in the same manner as the processing described above with reference to block 172 in FIG. 1 and illustrated with the additional compensation pixel 396 in FIG. 3D. The controller 80 subtracts the overlap threshold value from the total overlap parameter (block 236) and continues with process 200 for additional activated pixels in the pixel column corresponding to the inoperable inkjet (block 240).

After processing each of the activated pixels in the pixel column corresponding to the inoperable inkjet (block 240), the process 200 finishes processing the binary image data corresponding to the inoperable inkjet (block 244). In configurations where multiple inkjets in the printhead assemblies 32 and 34 are inoperable, the controller 80 performs process 200 for the binary image data corresponding to each of the inoperable inkjets. After processing the binary image data, the printer 10 prints the ink images using the modified binary image data to compensate for one or more inoperable inkjets.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for printing pixels in an image comprising:

identifying a pixel in image data to be printed by an inoperable inkjet in a plurality of inkjets;

identifying a first overlap parameter corresponding to the identified pixel and a plurality of pixels in the image data within a predetermined distance of the identified pixel, each pixel in the plurality of pixels to be printed by at least one inkjet in the plurality of the inkjets that is proximate to the inoperable inkjet;

identifying a first location in the image data for storage of a compensation pixel corresponding to the pixel to be printed by the inoperable inkjet, the first location being identified with reference to a predetermined sequence of pixel locations positioned about the pixel to be printed by the inoperable inkjet;

resetting the pixel to be printed by the inoperable inkjet;

identifying a second overlap parameter corresponding to the plurality of pixels in the image data within the predetermined distance of the identified pixel; and storing the compensation pixel in a second location in the image data in response to a difference between the first overlap parameter and the second overlap parameter exceeding a predetermined threshold, the second location being a position in the predetermined sequence that is further from the pixel to be printed by the inoperable inkjet than the first location is from the pixel to be printed by the inoperable inkjet.

2. The method of claim 1 further comprising:

storing another compensation pixel in the first location in the image data.

3. The method of claim 1, the identification of the first overlap parameter further comprising:

identifying each pixel in the plurality of pixels in the image data that are within a predetermined distance from the identified pixel;

identifying an individual overlap value for each identified pixel with reference to at least one of the other identified pixels in the plurality of pixels in the image data that are within a predetermined distance from the identified pixel;

identifying an individual overlap value for the pixel to be printed by the inoperable inkjet with reference to at least one of the other identified pixels in the plurality of pixels in the image data that are within a predetermined distance from the identified pixel; and identifying the first overlap parameter as a sum of the individual overlap values for each of the identified pixels and the individual overlap value for the pixel to be printed by the inoperable inkjet.

4. The method of claim 1, the identification of the second overlap parameter further comprising:

identifying each pixel in the plurality of pixels in the image data that are within a predetermined distance from the identified pixel;

identifying an individual overlap value for each identified pixel with reference to at least one of the other identified pixels in the plurality of pixels in the image data that are within a predetermined distance from the identified pixel;

identifying an individual overlap value for the compensation pixel in the first location with reference to at least one of the other identified pixels in the plurality of pixels in the image data that are within a predetermined distance from the identified pixel; and identifying the first overlap parameter as a sum of the individual overlap values for each of the identified pixels and the individual overlap value for the compensation pixel.

5. The method of claim 1 further comprising:

identifying another pixel in the image data to be printed by the inoperable inkjet;

identifying a third overlap parameter corresponding to the other identified pixel and another plurality of pixels in the image data proximate to the other identified pixel, each pixel in the other plurality of pixels in the image data being within a second predetermined distance from the other identified pixel, one of the pixels in the other plurality of pixels including the compensation pixel;

identifying a third location in the image data for storage of a compensation pixel corresponding to the other pixel to be printed by the inoperable inkjet, the third location being identified with reference to a predetermined sequence of pixel locations positioned about the other pixel to be printed by the inoperable inkjet;

resetting the other pixel to be printed by the inoperable inkjet;

identifying a fourth overlap parameter corresponding to the other plurality of pixels in the image data that are within a predetermined distance from the other identified pixel and the other compensation pixel; and storing the other compensation pixel in a fourth location in the image data in response to a difference between the third overlap parameter and the fourth overlap parameter exceeding a predetermined threshold, the fourth location being further from the other identified pixel than the third location is from the other identified pixel.

6. The method of claim 5 further comprising:

storing another compensation pixel in the third location in the image data.

7. A method for printing pixels in an image comprising:

identifying a pixel in image data to be printed by an inoperable inkjet in a plurality of inkjets;

identifying an overlap parameter corresponding to a plurality of pixels in the image data that are within a predetermined distance of the identified pixel to be printed by the inoperable inkjet;

incrementing a total overlap value by the identified overlap parameter;

resetting the pixel to be printed by the inoperable inkjet;

identifying a first location in the image data for storage of a compensation pixel corresponding to one of the plurality of pixels to be printed by the inoperable inkjet, the first location being identified with reference to a predetermined sequence of pixel locations positioned about the pixel to be printed by the inoperable inkjet; and storing the compensation pixel in a second location in the image data in response to the total overlap value exceeding a predetermined threshold, the second location being a position in the predetermined sequence that is further from the identified pixel that the first location is from the identified pixel.

8. The method of claim 7 further comprising:

storing another compensation pixel in the first location in the image data.

9. The method of claim 7, the identification of the overlap parameter further comprising:

identifying a number of pixels to be printed that are within the predetermined distance about the identified pixel; and identifying the overlap parameter with reference to the number of pixels to be printed and an overlap parameter value stored in a memory in association with the number of pixels.

10. The method of claim 7 further comprising:

adjusting the total overlap value in response to the compensation pixel being stored in the second location in the image data.

11. The method of claim 7, the second location in the image data being offset in a cross-process direction from the identified pixel.

12. The method of claim 11, the second location in the image data being offset in the cross-process direction from the first location in the image data.

13. The method of claim 11 further comprising:

operating one of the plurality of inkjets that is offset in the cross-process direction from the inoperable inkjet with reference to the compensation pixel in the second location in the image data.

14. An inkjet printer comprising:

a plurality of operable inkjets and an inoperable inkjet, each one of the operable inkjets being configured to eject ink onto an image receiving surface;

a memory configured to store image data, a total overlap value, and a plurality of overlap parameter values; and a controller operatively connected to the memory and the plurality of operable inkjets and the inoperable inkjet, the controller being configured to:

identify a pixel in the image data to be printed by the inoperable inkjet;

identify an overlap parameter stored in the memory that corresponds to a plurality of pixels in the image data that are within a predetermined distance of the identified pixel;

increase the total overlap value stored in the memory by the identified overlap parameter;

reset the identified pixel;

identify a first location in the image data for storage of a compensation pixel corresponding to one of the pixels within the predetermined distance from the identified pixel, the first location being identified with reference to a predetermined sequence of pixel locations positioned about the identified pixel; and store the compensation pixel in a second location in the image data in the memory in response to the total overlap value exceeding a predetermined threshold, the second location being a position in the predetermined sequence that is further from the identified pixel than the first location is from the identified pixel.

15. The inkjet printer of claim 14, the controller being further configured to:

store another compensation pixel in the first location in the image data in the memory.

16. The inkjet printer of claim 15, the controller being further configured to:

identify a number of pixels to be printed by the inoperable inkjet and by other inkjets in the plurality of inkjets that are within a predetermined region of the image data around the pixel to be printed by the inoperable inkjet; and identify the overlap parameter with reference to the identified number of pixels and one of the plurality of overlap parameter values stored in the memory in association with the identified number of pixels.

17. The inkjet printer of claim 14, the controller being further configured to:

adjust the total overlap value in response to the compensation pixel being stored in the second location in the image data.

18. The inkjet printer of claim 14, the second location in the image data being offset in a cross-process direction from the identified pixel.

19. The inkjet printer of claim 18, the second location in the image data being offset in the cross-process direction from the first location in the image data.

20. The inkjet printer of claim 18, the controller being further configured to:

operate one of the plurality of inkjets that is offset in the cross-process direction from the inoperable inkjet with reference to the compensation pixel in the second location in the image data.

* * * * *